US009227827B1

(12) United States Patent
Scott

(10) Patent No.: US 9,227,827 B1
(45) Date of Patent: Jan. 5, 2016

(54) LIQUID CONTAINER PRESSURIZATION AND DISPENSING DEVICE

(71) Applicant: Cromulent Conceptions, LLC, Denver, CO (US)

(72) Inventor: Robert Aubrey Scott, Denver, CO (US)

(73) Assignee: Cromulent Conceptions, LLC, Denver, CO (US)

( * ) Notice: Subject to any disclaimer, the term of this patent is extended or adjusted under 35 U.S.C. 154(b) by 0 days.

(21) Appl. No.: 14/062,565

(22) Filed: Oct. 24, 2013

Related U.S. Application Data

(60) Provisional application No. 61/717,974, filed on Oct. 24, 2012.

(51) Int. Cl.
*B65D 83/00* (2006.01)
*B67D 1/04* (2006.01)

(52) U.S. Cl.
CPC ..... *B67D 1/0418* (2013.01)

(58) Field of Classification Search
CPC ..... B67D 1/0004; B67D 1/008; B67D 2001/0091; B67D 2001/0092; B67D 2001/0098; B67D 1/04; B67D 1/0412; B67D 1/0418
USPC ..... 222/396, 397, 399, 400.7, 547, 564
See application file for complete search history.

(56) References Cited

U.S. PATENT DOCUMENTS 558,660 A * 4/1896 Reissing ..... 62/171
968,736 A * 8/1910 Brent ..... 222/399
1,648,575 A * 11/1927 Campbell ..... 141/197
1,912,439 A * 6/1933 Feller ..... 426/477
1,935,973 A * 11/1933 Altmann ..... 141/19
2,072,816 A * 3/1937 Hill, Jr. ..... 222/397
2,160,043 A * 5/1939 Threm ..... 222/399
2,172,035 A * 9/1939 Roth ..... 141/17
2,189,643 A * 2/1940 Ward ..... 141/17
2,190,688 A * 2/1940 Snelling ..... 141/17
2,208,490 A * 7/1940 Axtell ..... 169/88
2,222,247 A * 11/1940 Ward ..... 222/5
2,249,796 A * 7/1941 Davis ..... 222/5
2,367,077 A * 1/1945 Ward ..... 222/399

(Continued)

FOREIGN PATENT DOCUMENTS

CN 202244448 U 5/2012
WO 2013000932 A1 1/2013

*Primary Examiner* — Patrick M Buechner
(74) *Attorney, Agent, or Firm* — Morris, Manning & Martin, LLP; Daniel E. Sineway, Esq.

(57) ABSTRACT

An apparatus may be utilized for sealing a vessel and for providing various mechanisms for preserving and maintaining freshness of the vessel's contents. In one embodiment, the apparatus prevents a premature oxidation process by enabling a vessel to be filled with contents without compromising the seal of the vessel. Further, the apparatus eliminates the necessity of opening the vessel during the dispensing process, thereby maintaining the vessel's seal while emptying the vessel's contents. The apparatus may be initially purged of ambient air and oxygen prior to filling the vessel with contents further reducing premature oxidation by reducing a substance's oxygen contact as substances initially enter the vessel. The apparatus enables venting of excess gas, thereby preventing over-pressurization of the vessel's structure and over-pressurization of the contents within the vessel. The apparatus regulates the flow of incoming gas, whereby gas is introduced at a consistent rate preventing disruption of the contents.

20 Claims, 7 Drawing Sheets

(56) References Cited

U.S. PATENT DOCUMENTS

| | | | | | |
|---|---|---|---|---|---|
| 2,388,026 | A | * | 10/1945 | Ward | 137/630.22 |
| 2,552,857 | A | * | 5/1951 | Knapp | 222/547 |
| 2,596,414 | A | * | 5/1952 | Knapp | 251/321 |
| 2,705,578 | A | * | 4/1955 | Burns | 141/17 |
| 3,065,883 | A | * | 11/1962 | Nelson | 222/323 |
| 3,367,538 | A | * | 2/1968 | Hasselbeck et al. | 222/61 |
| 3,511,417 | A | * | 5/1970 | Rousset | 222/399 |
| 3,883,043 | A | * | 5/1975 | Lane | 222/82 |
| 3,927,801 | A | * | 12/1975 | Martin et al. | 222/61 |
| 3,976,221 | A | * | 8/1976 | Martin et al. | 222/61 |
| 4,350,270 | A | * | 9/1982 | Nezworski | 222/336 |
| 4,392,578 | A | * | 7/1983 | Fipp et al. | 215/231 |
| 4,473,174 | A | | 9/1984 | Heuser | |
| 4,532,690 | A | | 8/1985 | Del Bon et al. | |
| 4,632,276 | A | * | 12/1986 | Makino | 222/80 |
| 4,676,283 | A | | 6/1987 | Caldwell | |
| 4,860,932 | A | | 8/1989 | Nagy | |
| 5,022,565 | A | * | 6/1991 | Sturman et al. | 222/396 |
| 5,180,081 | A | | 1/1993 | McCann | |
| 5,329,975 | A | | 7/1994 | Heitel | |
| 5,395,012 | A | | 3/1995 | Grill et al. | |
| 5,443,186 | A | * | 8/1995 | Grill | 222/396 |
| 5,458,165 | A | * | 10/1995 | Liebmann, Jr. | 141/64 |
| 5,566,730 | A | | 10/1996 | Liebmann, Jr. | |
| 6,036,054 | A | * | 3/2000 | Grill | 222/3 |
| 7,100,799 | B2 | * | 9/2006 | Gruenewald et al. | 222/1 |
| 8,191,734 | B2 | | 6/2012 | Lupfer | |
| 8,191,740 | B2 | | 6/2012 | Hoss et al. | |
| 8,455,032 | B2 | | 6/2013 | Gormley et al. | |
| 2009/0224000 | A1 | * | 9/2009 | Lopez et al. | 222/152 |
| 2009/0283553 | A1 | * | 11/2009 | Hoss et al. | 222/396 |
| 2010/0028515 | A1 | | 2/2010 | Gormley | |
| 2011/0049193 | A1 | * | 3/2011 | Muller et al. | 222/399 |
| 2011/0151085 | A1 | | 6/2011 | Wallace | |
| 2011/0204093 | A1 | | 8/2011 | Lee | |
| 2013/0134190 | A1 | * | 5/2013 | Nyambi et al. | 222/399 |
| 2014/0262899 | A1 | * | 9/2014 | Mociak | 206/459.1 |
| 2015/0014367 | A1 | * | 1/2015 | VanSyckel | B67D 1/0412 222/399 |

* cited by examiner

LIQUID CONTAINER PRESSURIZATION AND DISPENSING DEVICE

CROSS REFERENCE TO RELATED APPLICATION

This application claims benefit under 35 U.S.C. §119(e) of U.S. Provisional Patent Application No. 61/717,974, filed Oct. 24, 2012, and entitled "Liquid Container or 'Growler' Pressurization and Dispensing Device", which is incorporated herein by reference as if set forth herein in its entirety.

TECHNICAL FIELD

The present disclosure relates generally to an apparatus or device for maintaining a seal on a vessel and maintaining adequate pressure within the vessel, and more particularly to an apparatus for pressurizing a liquid-filled vessel (such as a beer growler) without compromising the contents of the vessel, maintaining a predetermined pressure within the vessel, re-pressurizing the vessel as needed, and enabling easy dispensing of the contents within the vessel.

BACKGROUND

It is well understood that many people store and maintain various types of contents inside of a storage container or vessel. Storage containers generally appear in a plurality of shapes and sizes, and are typically used for many different purposes (e.g., storage, portability, encapsulating contents, etc.). Depending on the utilization intent and/or the storage location of the vessel, many vessels comprise different types of material (e.g., plastic, glass, metal, cloth, etc.) comprising different rigidities suitable for the intended use. Generally, the intent of utilizing a storage vessel is to ensure the contents are secure within the vessel by sealing the contents via a cap, plunger, stopper, lid, or other enclosing means. Many vessels, especially those for storing liquids, are used for transportation purposes to transport the liquid from one place to another.

Generally, sealing a vessel ensures the contents inside of the vessel do not escape and avoids introduction of unwanted external elements to the contents within the vessel. In addition, sealing a vessel may ensure the contents remain fresh and in a desired state when a person wants to use or consume the contents. Occasionally it is necessary to ensure an adequate sealing cap is utilized for enabling the contents to remain preserved. For example, not properly replacing a sealing lid or cap on some food may spoil the food. Further, when a person has the desire to utilize the contents within the vessel, the sealing cap must be removed to access the contents of the vessel. In some instances, removing the sealing lid to access the contents may introduce unwanted substances to the interior of the vessel or further promote a loss of freshness.

A "growler" is a container generally used to transport and store liquids such as water or wine, but growlers are most often used for beer. Beer growlers are manufactured in a variety of sizes (e.g., 32 fluid oz., 64 fluid oz., etc.) and generally comprise a lid (e.g., screw on, plunger style, etc.) for sealing in the contents and enabling storage and transport. Beer growlers have become very popular for small breweries that generally do not have the means or capacity to can/bottle beer. Beer growlers allow small breweries to sell and share beer with patrons and those wishing to sample their beer.

Unfortunately, when a beer growler is opened for the first time after it is initially filled, due to the oxidation process of the beer that occurs while pouring the beer in a glass, the beer does not retain its freshness and typically goes "flat" within a few hours. Additionally, during the pouring process there is a loss of carbon dioxide from within the vessel and the beer, which further encourages a loss of freshness. Furthermore, when a brewery fills the beer growler for the first time, the turbulence associated with the flow of the incoming beer mixes with the oxygen already present in the growler and promotes a premature oxidation process beginning after the initial filling of the growler.

Therefore, there is a long-felt, but unresolved need for a device that seals a vessel and enables said vessel to receive and discharge contents without compromising the seal. There is a further need for a device to re-pressurize the vessel's interior as desired and maintain adequate pressure within the vessel.

BRIEF SUMMARY OF THE DISCLOSURE

Briefly described, and according to one embodiment, aspects of the present disclosure generally relate to apparatuses for pressurizing a liquid-filled vessel (such as a beer growler) without compromising the contents of the vessel, maintaining a predetermined pressure within the vessel, re-pressurizing the vessel as needed, and enabling easy dispensing of the contents within the vessel.

According to one aspect of the present disclosure, an apparatus may be utilized for sealing a vessel as well as providing various mechanisms for preserving and maintaining freshness of the vessel's contents. In one embodiment, the apparatus prevents a premature oxidation process by enabling a vessel to be filled with desired contents without compromising the seal of the vessel. Further, according to another embodiment, the apparatus eliminates the necessity of opening the vessel during the dispensing or pouring process, thereby maintaining the vessel's seal while emptying the vessel's contents. According to yet another embodiment, the apparatus may be initially purged of ambient air and oxygen prior to filling the vessel with said contents. This enables a further reduction of premature oxidation by reducing a substance's oxygen contact as substances initially enter the vessel. As will be described in greater detail below, aspects of the present apparatus may be utilized to seal various types of liquid in a vessel while maintaining the liquid's freshness, preserving a seal on the vessel, and upholding adequate pressure within the vessel as desired.

According to further embodiments, the apparatus enables venting of excess gas, thereby preventing over-pressurization of the vessel's structure and over-pressurization of the contents within the vessel. Generally, to maintain freshness and provide an optimal environment for content storage, an adequate amount of gas is required to stay within a vessel. In addition, one embodiment of the apparatus regulates the flow of incoming gas, whereby gas is generally introduced at a consistent rate preventing disruption of the contents. Preventing disruption of the contents ensures adequate content preservation (e.g., no excess foaming of the contents, not disturbing intentionally settled contents, etc.), thereby properly utilizing the sealing and preserving mechanism. In yet a further embodiment, aspects of the present apparatus include one or more restrictor elements that prevents the sealed liquid from entering the gas venting mechanisms or the gas introduction assemblies.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
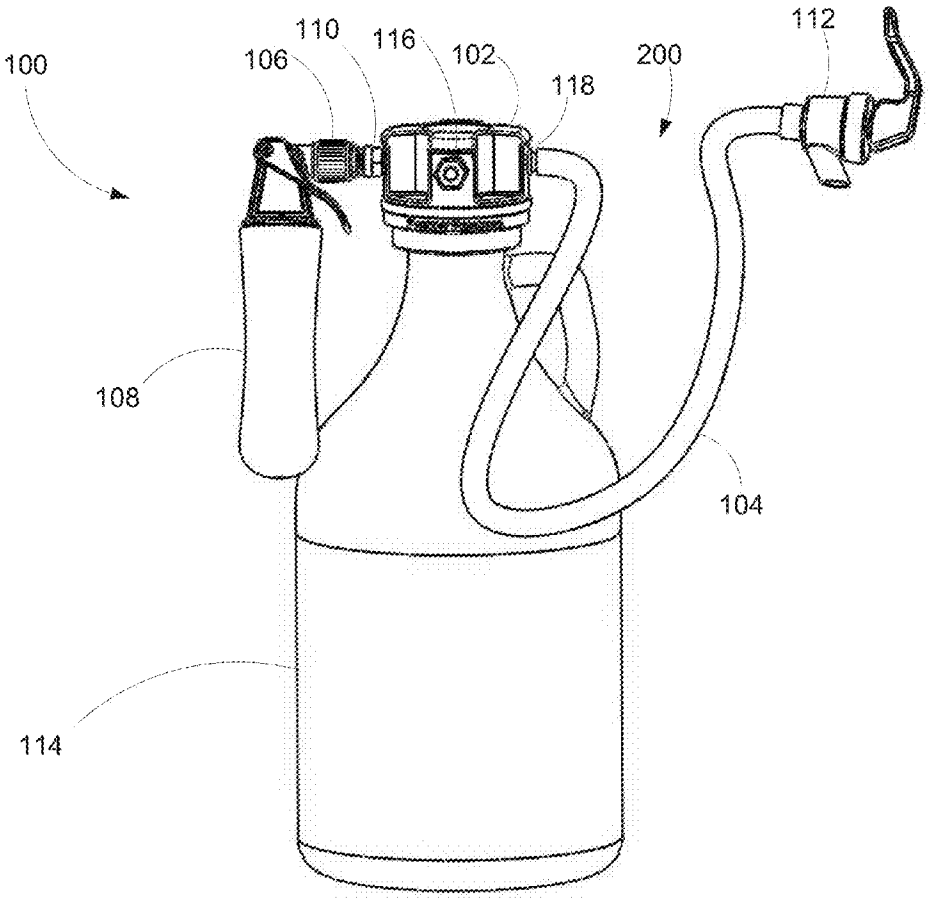
FIG. 1 illustrates an isometric view of an embodiment of the present device in use on a vessel, according to one embodiment of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments and any further applications of the principles of the disclosure as illustrated therein are contemplated as would normally occur to one skilled in the art to which the disclosure relates. All limitations of scope should be determined in accordance with and as expressed in the claims.

Overview

Aspects of the present disclosure generally relate to apparatuses for pressurizing a liquid-filled vessel (such as a beer growler) without compromising the contents of the vessel, maintaining a predetermined pressure within the vessel, repressurizing the vessel as needed, and enabling easy dispensing of the contents within the vessel.

According to one aspect of the present disclosure, an apparatus may be utilized for sealing a vessel as well as providing various mechanisms for preserving and maintaining freshness of the vessel's contents. In one embodiment, the apparatus prevents a premature oxidation process by enabling a vessel to be filled with desired contents without compromising the seal of the vessel. Further, according to another embodiment, the apparatus eliminates the necessity of opening the vessel during the dispensing or pouring process, thereby maintaining the vessel's seal while emptying the vessel's contents. According to yet another embodiment, the apparatus may be initially purged of ambient air and oxygen prior to filling the vessel with said contents. This enables a further reduction of premature oxidation by reducing a substance's oxygen contact as substances initially enter the vessel. As will be described in greater detail below, aspects of the present apparatus may be utilized to seal various types of liquid in a vessel while maintaining the liquid's freshness, preserving a seal on the vessel, and upholding adequate pressure within the vessel as desired.

According to further embodiments, the apparatus enables venting of excess gas, thereby preventing over-pressurization of the vessel's structure and over-pressurization of the contents within the vessel. Generally, to maintain freshness and provide an optimal environment for content storage, an adequate amount of gas is required to stay within a vessel. In addition, one embodiment of the apparatus regulates the flow of incoming gas, whereby gas is generally introduced at a consistent rate preventing disruption of the contents. Preventing disruption of the contents ensures adequate content preservation (e.g., no excess foaming of the contents, not disturbing intentionally settled contents, etc.), thereby properly utilizing the sealing and preserving mechanism. In yet a further embodiment, aspects of the present apparatus include one or more restrictor elements that prevents the sealed liquid from entering the gas venting mechanisms or the gas introduction assemblies.

A detailed description of certain exemplary embodiments of the present apparatus is provided below in reference to the various patent figures and illustrations.

Exemplary Embodiments

Referring now to the figures, FIG. 1 illustrates a perspective view of an exemplary embodiment of a sealing apparatus 100 (also referred to herein as a "sealing device" or "pressurization and dispensing device") according to the present disclosure. According to one aspect and as previously described, a sealing apparatus 100 is used to preserve various types of contents (e.g., liquid, perishable food, grains, etc.) within a vessel 114, maintain adequate pressure within said vessel 114, and discharge/fill the contents of the vessel without significant loss of the pressure of the vessel.

Preferably, the vessel 114 described herein comprises a beer growler or other similar vessel. As will be understood and appreciated, however, many other vessels that are used for pressurization and storage of liquid or similar contents may be used in conjunction with the sealing apparatus 100 as described in the present disclosure.

As shown in FIG. 1, the sealing apparatus 100 is generally placed on top of the vessel's orifice for providing a sealing mechanism for the vessel 114. The body of the sealing apparatus generally comprises a cast cap 102 that is typically manufactured from a rigid, durable material (e.g., fiberglass, plastic, metal, polymers, etc.) ensuring the apparatus performs all of its intended functions. Further, according to one embodiment of the present disclosure, the sealing apparatus 100 comprises a mechanism for securely affixing the sealing apparatus 100 to the exemplary vessel 114, such as a screw top or snap fit mechanism (not shown in FIG. 1, but described later in the disclosure).

In one embodiment, the sealing apparatus 100 comprises a discharge sub-assembly 200 for dispensing the liquid contained within the vessel 114. In one embodiment, the discharge assembly includes a dispensing tube 104 (also referred to herein as a "discharge tube") enabling a containerized flow of a substance in and out of the vessel 114. According to one embodiment, a flow regulating apparatus 112 (e.g., a picnic-style faucet) is affixed onto one end of the dispensing tube 104 to ensure adequate and proper flow is maintained as the contents enter/exit the vessel 114. Further, as shown in FIG. 1, the sealing apparatus 100 generally includes a gas connector 106 for affixing an exemplary gas-dispensing container 108 onto the gas inlet valve 110. Generally, the gas-dispensing container 108 is utilized to inject gas (e.g., carbon dioxide ($CO_2$)) into the vessel for re-pressurizing the vessel 114 as well as purging the vessel of oxygen and air before filling the vessel 114 with desired contents.

According to one embodiment shown in FIG. 1, the sealing apparatus 100 comprises a pressure relief valve 116 for relieving the pressure within the vessel by expelling excess gas (e.g., air, carbon dioxide ($CO_2$), nitrogen (N), oxygen ($O_2$), etc.) from the interior of the vessel 114. Generally, the desired pressure within the vessel 114 for beer growlers is between 7-15 pounds per square inch (psi), and preferably around 9 psi. According to one aspect, as gas reaches a higher than expected pressure (greater than approximately 9 psi) within the vessel 114, which can occur during various conditions (e.g., filling the vessel 114, injecting additional gas into the vessel 114, dispensing contents from the vessel, excess heat, etc.), the pressure relief valve 116 can be opened to vent excess gas from inside the vessel, subsequently lowering the pressure within the vessel 114.

In some embodiments, the pressure relief valve is manufactured and regulated to operate automatically within certain predetermined parameters. For example, should the pressure within the vessel 114 exceed a predetermined threshold (e.g., 15 psi), the pressure relief valve automatically breaks its seal and allows for dispensing of the internal gas of the vessel. Once the pressure of the gas and liquid within the vessel returns to an acceptable range, the pressure relief valve 116 returns to a seated/sealed position.

According to one aspect of the discharge sub-assembly 200, the dispensing tube 104 comprises a rigid, but malleable material (e.g., plastic, polymer, rubber, braided hose, etc.) and serves as a containerizing mechanism that directs contents to and from the vessel. According to one aspect, the inner diameter of the discharge tube 104 is generally ¼ inch, but as will be understood and appreciated by one of ordinary skill in the art, the tube inner diameter may comprise a plurality of sizes. Similarly, the length of the dispensing tube may vary according to the intended use of the present device. In yet another aspect, the dispensing tube 104 may comprise a completely rigid material (e.g., metal, non-malleable plastic or polymer, etc.) that maintains a fixed position and does not move according to an intended position.

According to one embodiment illustrated in FIG. 1, a content discharge valve 118 provides a connecting interface for the discharge tube 104 and the interior of the cast cap 102. Generally, the content discharge valve 118 enables the sealing apparatus 100 to maintain a tight and controlled seal of the vessel 114 while simultaneously providing a dispelling perforation for discharging contents (liquid) from within the vessel. According to one aspect of the present disclosure, the content discharge valve 118 generally comprises a rigid material (e.g., metal, fiberglass, plastic, polymer, etc.) maintaining a secured position within the cast cap 102 as well as slightly protruding from the cast cap 102 to enable engagement with the dispensing tube 104.

In one embodiment, the content discharge valve 118 comprises a nozzle dually threaded enabling one end to screw into the cast cap 102 and the other end on to the discharge tube 104. In another embodiment, a content discharge valve 118 comprises a cylindrical tube that inserts into the cast cap 102 and is affixed via some other mechanism. For example, the content discharge valve may be securely and releasably affixed to the cast cap 102 via an adhesive mechanism (e.g., high strength adhesive, epoxy, high strength glue, etc.), snap fit, friction hold, etc.

Generally, the outwardly protruding end of the cylindrical content discharge valve 118 comprises a diameter small enough to enable the discharge tube 104 to securely and tightly slide over the content discharge valve 118. In yet another embodiment, the content discharge valve 118 comprises a cylindrical tube with one end smooth comprising a small enough diameter to fit conveniently into the cast cap 102 and one end comprising threads to secure the discharge tube 104. Similarly, in another embodiment, a threaded end may insert into the cast cap 102 and a smooth end may engage the discharge tube 104.

As shown in FIG. 1 and previously discussed, the discharge sub-assembly 200 generally comprises a flow regulating apparatus 112 affixed to the discharge tube 104 that enables dispelling of contents from the vessel at a desired and appropriate rate. In one embodiment, the flow regulating apparatus 112 comprises an internal valve affixed to a button that opens when the button is depressed. According to one aspect, the orifice blocked by the valve is completely exposed regardless to what degree the button is depressed. According to another aspect, the valve opens in accordance with the extent the button is depressed. In another embodiment, the flow regulating apparatus 112 comprises a valve interfaced with an actuator and a lever attached to the actuator. The lever engages the actuator; thereby opening the valve to the degree the lever is engaged. In yet another embodiment, the flow regulating apparatus 112 comprises a rotational valve affixed to a stem and an interfacing fixture (e.g., lever, knob, handle, etc.). Rotating the fixture enables, via the stem, the valve to rotate and expose the discharge perforation of the discharge tube 104 allowing contents to discharge from the vessel 114.

The sealing apparatus 100 also includes internal and integral embodiments (not shown in FIG. 1, but described in further detail below) adding further function according to the device of the present disclosure. According to other embodiments not shown in FIG. 1 (but described in greater detail below), the sealing apparatus 100 comprises a gas supply tube used as the enclosed pathway within the cast cap 102 for gas entering the vessel 114, a contents out tube that is a mechanism for contents to travel in and out of the vessel 114, and a contents out valve for connecting the dispensing tube 104 to the contents out tube. Various embodiments illustrated in FIG. 1 and those not illustrated in FIG. 1 will be further described in connection with FIGS. 2-6.

The discussions above in association with FIG. 1 are merely intended to provide an overview of an embodiment of the present system and apparatus for sealing contents within a vessel, maintaining adequate pressure within a vessel, and for discharging and inserting contents (e.g., liquid and gas) into a vessel. Accordingly, it will be understood that the descriptions in this disclosure are not intended to limit in any way the scope of the present disclosure. Various physical and functional descriptions of embodiments comprising the sealing apparatus will be described next in further detail.

Figure 2:
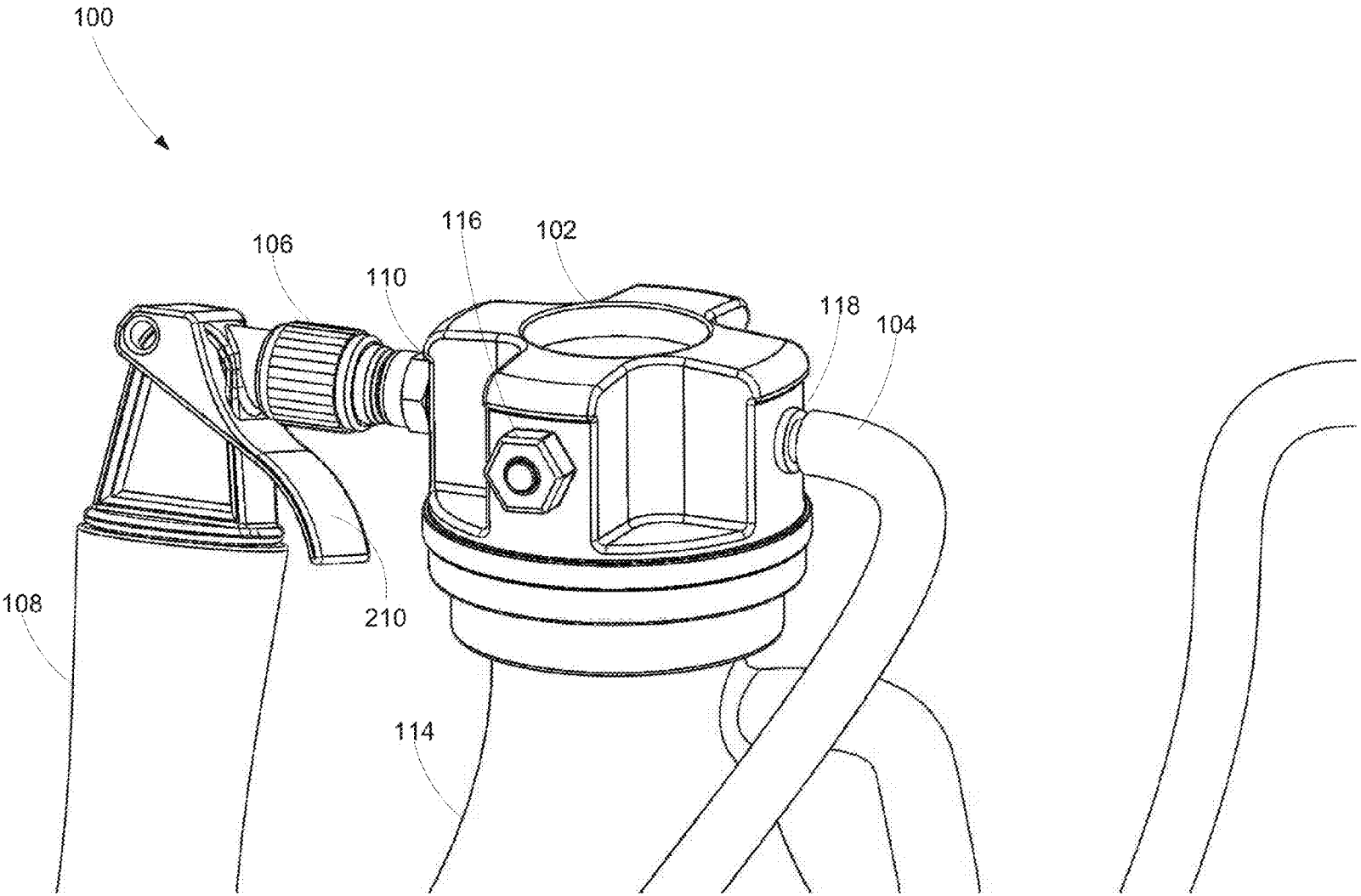
FIG. 2 is a magnified perspective view of one embodiment of the disclosed device in use with a vessel.

FIG. 2 illustrates an exemplary magnified perspective view of a sealing apparatus 100 affixed to a vessel 114 according to one aspect of the present disclosure. In one embodiment, a pressure relief valve 116 may comprise a hinge and flapper system as a mechanism for venting excess gas from within the vessel 114. Generally, a combination of the weight of the flapper and the tension within the hinge maintains the flapper in place covering the exiting orifice. In one embodiment, pressure reaching a level high enough to overcome the tension of the hinge and the weight of the flapper will push the flapper open, and enable excess gas to escape. According to one aspect of the present embodiment, the flapper may comprise a small protrusion that inserts into the exiting orifice of the cast cap 102 sealing the vessel 114 and the contents inside. Another aspect may comprise of a flapper that covers the exiting orifice. Yet another aspect may comprise a flapper with a slightly larger diameter that covers and seals the exiting orifice, preventing gas from escaping the vessel during normal operation. Moreover, according to another embodiment, the pressure relief valve 116 may comprise a flapper conjoined with a small bar. Similar to the aforementioned characteristics, the resistance due to the weight of the flapper conjoined with the connecting medium of the bar provides the necessary tension to maintain the desired pressure within the vessel. As will be understood and appreciated, the vessel 114 should remain pressurized within a predetermined range when carbonated beverages (e.g., beer, soda, etc.) are contained therein.

According to another embodiment of the present disclosure, the pressure relief valve 116 comprises a circular enclosure with a diaphragm shaped as a slightly concave disc set in the interior of the circular enclosure. Generally, the diaphragm is comprised of a rigid or semi rigid material (e.g., plastic, polymer, rubber, etc.). In one aspect, the diaphragm seats into place sealing the exiting orifice when the pressure within the vessel 114 is below the desired pressure. Moreover, various aspects may comprise a diaphragm with a small protrusion that fits in the exiting orifice or a diaphragm that slightly covers the exiting orifice sealing the vessel 114. Accordingly, when the pressure elevates above the desired threshold, enough force is generated to lift the diaphragm allowing excess gas to exit the vessel 114, thereby lowering the vessel's internal pressure to the desired level.

In further embodiments, the pressure relief valve 116 can be manually operated by a user pulling on the valve to cause unseating of the valve. For example, if the valve 116 comprises a spring-loaded member held in tension in a sealed position against the vessel 114, the user can pull the valve outward (thereby allowing gas to escape), and then release the valve (thereby returning it to a seated position). In other embodiments, the settings of the pressure relief valve 116 can be pre-set such that it automatically becomes unseated when certain threshold pressure levels within the vessel 114 are reached.

In one embodiment of the present apparatus 100, a discharge assembly 200 (as shown in FIG. 1) generally comprises a discharge tube 104 that is attached on one end to a flow regulating apparatus 112 and on the other end to a content discharge valve 118. Generally, the discharge assembly enables content to enter and exit the vessel 114 without significantly affecting the pressure maintained within the vessel (by the sealing apparatus 100). In another embodiment, the discharge assembly 200 may comprise a content discharge valve 118 directly coupled to a flow regulating apparatus 112, thereby eliminating the discharge tube 104. Similarly, according to such an embodiment, the discharge assembly 200 still enables content to enter and exit the vessel without compromising the seal of the vessel, thereby reducing the introduction of oxygen during the processes of filling and discharging contents from within the vessel. Accordingly, during the filling process, an external tube used to fill the vessel 114 is attached to the inlet/outlet orifice of the flow regulating apparatus 112 and desired contents are injected into the vessel.

Still referring to FIG. 2, in one embodiment, a sealing apparatus 100 generally comprises a pressurized gas supply 108 enabling the sealing apparatus 100 to inject additional gas into the vessel. Generally, attached to the pressurized gas supply is a gas activation trigger that allows a user of the device 100 to inject gas into the vessel 114. As will be understood by one of ordinary skill in the art, the gas may comprise oxygen ($O_2$), carbon dioxide ($CO_2$), nitrogen (N), or the like. Generally, the sealing apparatus utilizes a pressurized gas supply 108 comprising compressed CO2 to re-pressurize the contents within the vessel. As described previously, carbonated or other similar types of liquids, such as beer or soda, generally require pressurization within the vessel in order to remain fresh. Further, according to one aspect, the pressurized gas supply 108 may be used to conduct an initial oxygen/ambient air purge of an empty vessel 114 prior to introducing contents to the interior of the vessel 114. Initially purging the interior of a vessel 114 promotes reduced premature oxidation of the contents. Because the pressure of the incoming liquid is generally higher than inside the vessel 114, the incoming liquid will displace the gas within the vessel and expel the excess gas through the pressure relief valve 116 until the liquid within the vessel is at a desired level, thereby leaving the appropriate amount of gas remaining inside. In one embodiment, the pressurized gas supply 108 generally comprises a portable canister of pressurized gas (e.g., a disposable $CO_2$ container), but as will be understood by one of ordinary skill in the art, the pressurized gas supply 108 may comprise various different sized canisters with a connecting mechanism. For example, a pressurized gas supply 108 may comprise a large tank with a hose (e.g., metal, rubber, polymer, etc.) affixed to the gas connector 106.

As further shown in an embodiment of FIG. 2, a gas connector 106 is utilized to connect the pressurized gas supply 108 to the gas inlet valve 110. Typically, a gas inlet valve 110 enables pressurized gas entry to the vessel. According to one aspect, a gas inlet valve generally comprises a cylindrical device with a threaded end that engages with a gas connector 106 and smooth opposing end that is inserted into the cast cap 102. Accordingly, the gas connector 106 may comprise an orifice manufactured with internal thread that screws on the threaded portion of the gas inlet valve 110. Another aspect of the gas inlet valve 110 may comprise a dually threaded cylindrical device, wherein one end is screwed into the cast cap 102, and the other end is attached to the gas connector 106 via internal threads within the gas connector 106. Further, another aspect may comprise a ball-post lock (not shown), wherein the gas connector 106 comprises a collar and the gas inlet valve 110 comprises a cylindrical device including a post with small spheres integrated into the post. The gas connector 106 slides over the gas inlet valve 110 and is secured in place utilizing the integrated spheres and recessions in the interior of the collar. The spheres aptly fit within the internal recession securing the gas connector to the gas inlet valve 110. As will be generally understood and appreciated by one of ordinary skill in the art, any further mechanism for securing a pressurized gas supply 108 to a gas inlet valve 110 via a gas connector 106 may be utilized; further, any combination of the aforementioned embodiments may also be used.

Figure 3:
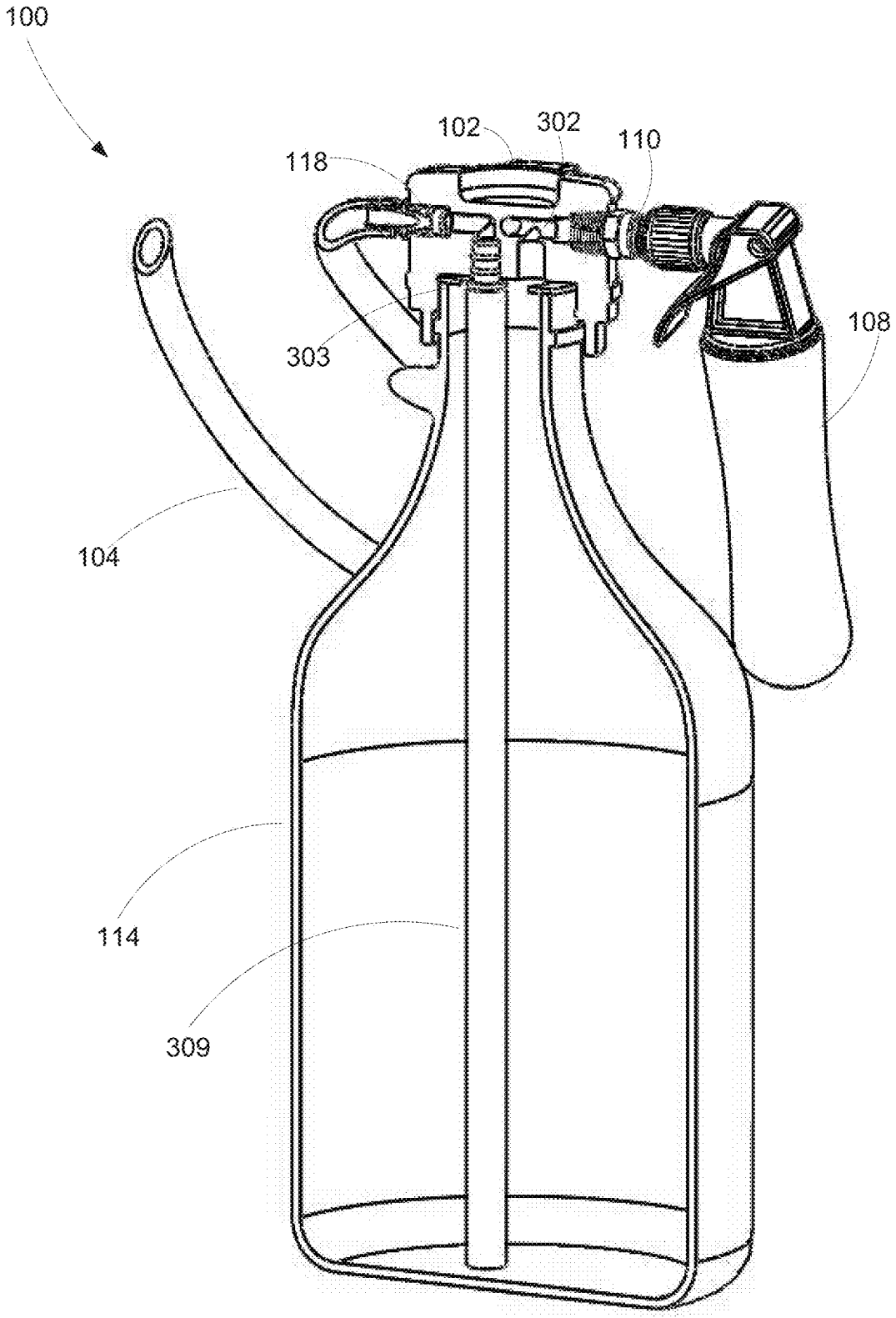
FIG. 3 illustrates a cross-sectional view of one embodiment of the device in use with a vessel.

FIG. 3 illustrates an exemplary cross-sectional view of a an embodiment of the sealing apparatus 100 in use on a vessel 114. FIG. 3 illustrates various internal embodiments of the sealing apparatus 100 that manages the freshness of the contents/liquid, provide mechanisms for dispensing and filling the contents of the vessel without breaking its seal, and maintaining adequate pressure within the vessel. For example, a sealing apparatus 100 generally comprises a content out tube 309 providing an enclosed mechanism for directing the flow of contents in/out of the vessel 114. According to one aspect, the content out tube 309 typically comprises a thin walled, non-corrosive material (e.g., plastic, polymer, metal, etc.) comprising approximately ¼ inch inner diameter and ten inches in length. According to another aspect, the content out tube 309 may be trimmed or extended to provide additional functionality. Further, the content out tube 309 may comprise various inner diameters according to preferred functionality including desired flow characteristics.

Figure 5:
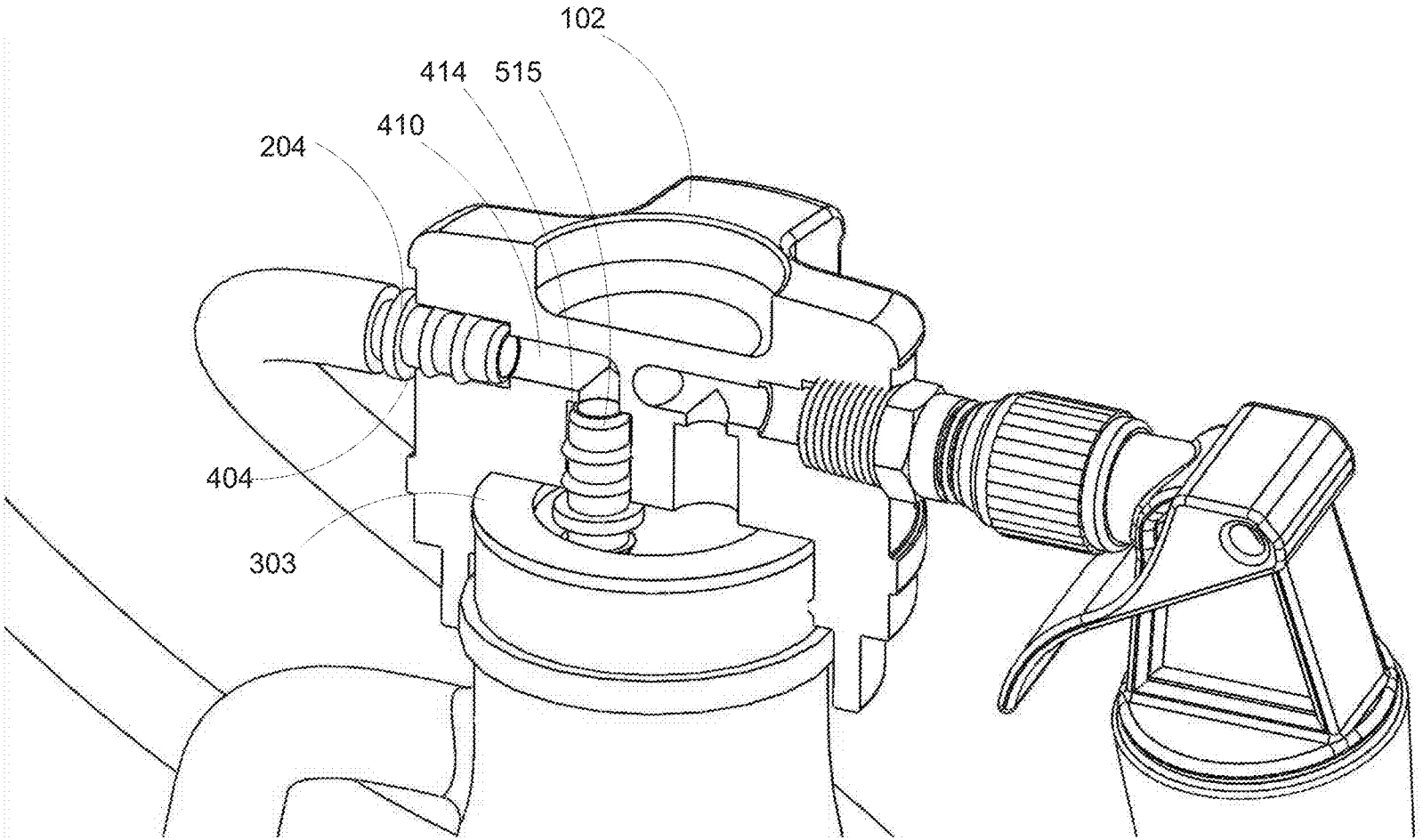
FIG. 5 is a magnified cross-sectional view of the present device, according to one embodiment of the present disclosure.

Furthermore, one embodiment of the present devices comprises an internal gasket 303 for ensuring a proper seal of the device 100 on the vessel 114 such that gas and liquid do not escape the vessel when the device 100 is in use. An improper seal will allow the pressurized gas within the vessel 114 to unintentionally escape, thereby enabling the contents/liquid, which relies on the pressurized gas to preserve freshness, to exhibit a slow or rapid decline in freshness. An internal gasket 303 seals the surface of the vessel's orifice from a small gap within the seal apparatus body 102. According to one aspect, the internal gasket 303 typically comprises a hardened material (e.g., rubber, plastic, polymer, etc.). An additional view of the gasket 303 is shown in FIG. 5.

As shown in FIG. 3, one embodiment comprising a gas supply tube 302 (or channel) that enables pressurized gas to enter the cast cap 102. According to one aspect, the gas supply tube 302 comprises a rigid thin walled material (e.g., plastic polymer, metal, etc.) tube inserted into the cast cap 102. In another aspect (and as shown in FIG. 3), the gas supply tube 302 simply comprises a channel that is cast molded into the cast cap 102. Further, the gas supply tube 302 is generally, but necessarily one inch in length starting at the outer edge of the cast cap 102. As will be understood and appreciated by one of ordinary skill in the art, the length of the gas supply integral channel 302 can vary according to manufacturing and operating requirements of the present device. Further details regarding the gas supply tube 302 will be described in connection with FIG. 4.

Further, to route the incoming pressurized gas into the vessel 114, a gas supply tube 302 is integral to the cast cap 102. Pressurized gas exiting the gas supply canister 108 enters the vessel 114 through the gas supply tube 302. According to one aspect, the gas supply tube 302 comprises a rigid thin walled material (e.g., plastic, polymer, metal, etc.) tube inserted in to the cast cap 102 with an inner diameter of approximately ¼ inch. As will be understood by one of ordinary skill in the art, various other aspects may comprise a larger or smaller inner diameter enabling additional functionality, such as varying flow and velocity characteristics of the sealing apparatus 100. According to another aspect, a gas supply tube 302 may be molded into the cast cap 102 providing a pathway for the incoming pressurized gas.

In one embodiment, the apparatus 100 attaches to the vessel 114 via a screw mechanism (similar to a standard bottle cap). In other aspects, the apparatus attaches to the vessel via a snap-fit mechanism, a friction hold, or other similar attachment means.

Figure 4:
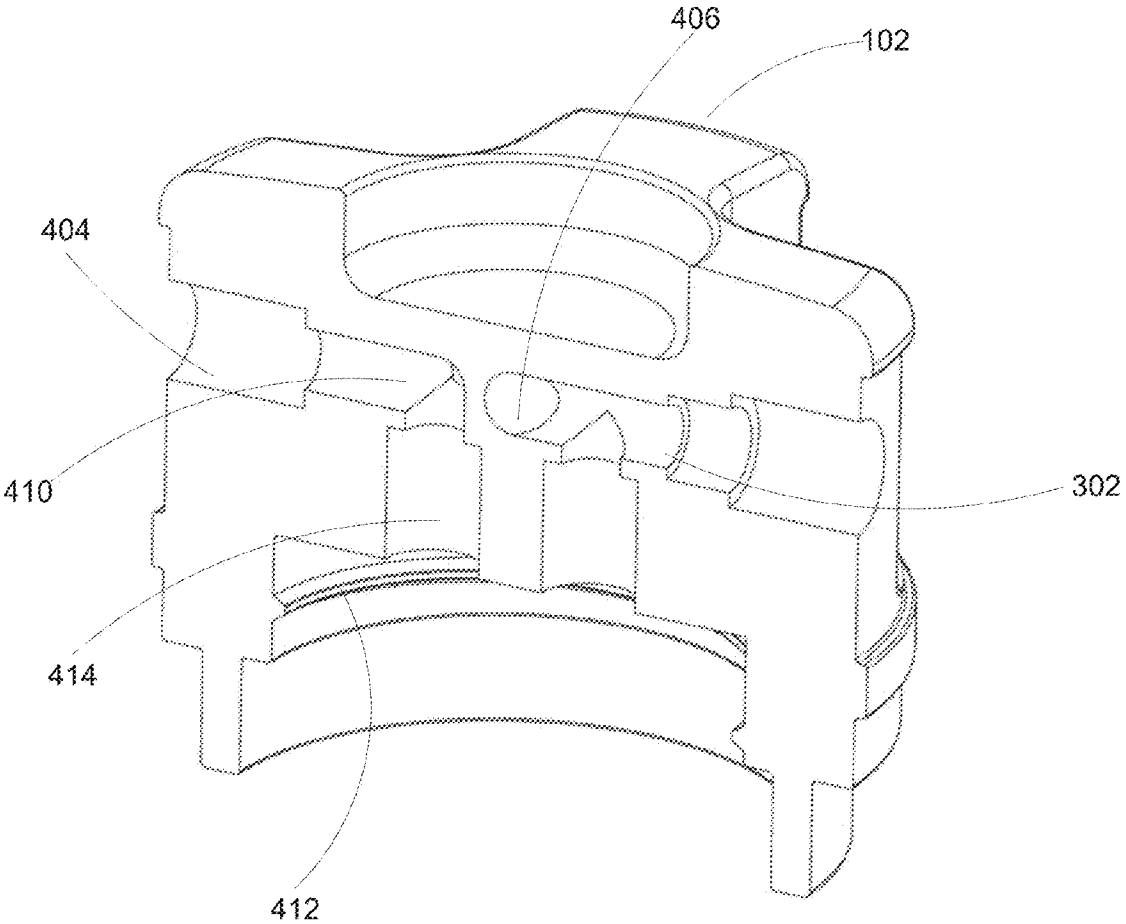
FIG. 4 illustrates a magnified cross-sectional view of the cast cap of the device, according to one embodiment of the present disclosure.

FIG. 4 illustrates an exemplary magnified cross-sectional view of the cast cap 102, the various valves, and internal components of the apparatus. As previously mentioned, the gas supply channel 302 enables the pressurized gas entry into the cast cap 102. As illustrated in FIG. 4, one aspect of the gas supply integral tube provides the gas inlet valve 110 with a mechanism for engaging and inserting into the cast cap 102. The gas supply channel 302 generally provides an orifice of sufficient size for the gas inlet valve 110 to insert into the cast cap 102, while leaving a minimal clearance ensuring the gas connector 106 is secure within the cast cap 102. According to one aspect and as previously mentioned, the gas inlet valve 110 (not shown here, but pictured later in FIGS. 6 and 7) generally comprises a smooth inlet segment wherein the smooth inlet segment is inserted into the cast cap 102 and secured via a securing mechanism (e.g., high-strength adhesive, epoxy, glue, screw assembly, etc.). As will be understood by one of ordinary skill in the art, the gas inlet valve 110 may comprise some other mechanism for securing the gas inlet valve 110 into the cast cap 102, and the aforementioned mechanism is not intended to limit the scope or the spirit of the present disclosure.

In one embodiment (and as described previously), a securing mechanism is utilized to attach the sealing apparatus 100 to the vessel 114 enabling an isolation of the inside substance(s) from the outside environment. Isolating the substances from the external environment typically preserves the freshness of the substances and ensures the internal liquid is not contaminated by possible foreign matter. In one embodiment, a sealing apparatus 100 generally comprises integral threads 412 within the cast cap 102 that are used to screw the sealing apparatus 100 onto the vessel 114 as a mechanism for affixing the sealing apparatus 100. According to one aspect, the internal threads 412 are approximately, but not necessarily 1 7/16 inches. Further aspects may comprise various internal thread 412 sizes allowing the sealing apparatus to be compatible with a plurality of vessels of different sizes and types.

As will be generally understood by one of ordinary skill in the art, various other embodiments may be used as a securing mechanism. For example, in one embodiment, the sealing apparatus 100 may comprise a latching system for securely attaching the sealing apparatus 100 to the vessel 114. The cast cap may comprise a latch system that is exercised by securing the latches around the body of the vessel 114. Another embodiment may comprise a plunger style sealing mechanism that comprises a cylindrical protrusion with a slightly smaller diameter than the orifice of the vessel 114, and is inserted inside the vessel through the orifice sealing in the contents.

FIG. 4 shows one embodiment of the present device 100 comprising a pressure relief exit 406 providing a pathway for excess gas to travel to the pressure relief valve 116 (not shown in FIG. 4). As previously described, the pressure relief valve 116 prevents over-pressurization of the contents as well as over-pressurization of the vessel. The pressure relief exit 406 ensures excess pressurized gas attains access to the pressure relief valve 116 by providing a mechanism for which the pressure relief valve 116 engages with the cast cap 116. According to one aspect, the pressure relief valve is inserted into the pressure relief exit 406. Generally, the pressure relief exit 406 is molded into the cast cap 102, but as will be understood by one of ordinary skill in the art, the pressure relief exit 406 may comprise some other mechanism to enable similar function such as a rigid tube placed inside the cast cap 102.

Further illustrated in FIG. 4 is a content out tube connector sleeve 414 enabling the content out tube 309 (shown previously in connection with FIG. 3) to fit securely within the bottom of the cast cap 102. The content out tube connector sleeve 414 generally houses the liquid out tube connector (not shown here but discussed in connection with FIG. 5). The liquid out tube connector sleeve 414 generally comprises a diameter large enough to house the content out tube connector. Similarly, in one embodiment, an inlet/outlet orifice 404, which is connected to the content out tube connector sleeve 414 via the content access tube 410, serves as the portal for incoming and discharging contents/liquid to and from the vessel 114. Further, the inlet/outlet orifice 404 generally houses the content discharge valve 118 (not shown here but discussed in further detail in connection with FIG. 5).

According to one embodiment illustrated in FIG. 5, the liquid access tube 410 provides an engaging mechanism for the content discharge valve 118 and the cast cap 102. As shown in FIG. 5 and according to one aspect of the present device 100, the liquid access tube 410 offers a unitary corridor from the content out tube connector 515 (described later) to the content discharge valve 118. A further aspect of the liquid access tube 410 comprises an inlet/outlet orifice 404 suitably sized to house the content discharge valve 118. As previously described and according to one aspect, the interior of the inlet/outlet orifice 404 is generally smooth, thereby enabling insertion of the content discharge valve 118. In one aspect, the liquid access tube 410 is typically molded into the cast cap. In yet another aspect, the liquid access tube may comprise a thin walled tube comprised of a rigid material (e.g., polymer, metal, plastic, etc.) inserted into the cast cap 102. The content discharge valve 118 may be secured utilizing a securing mechanism such as epoxy, high-strength adhesive, threads, etc. As will be generally understood by one of ordinary skill in the art, the aforementioned securing mechanism is not intended to limit the scope or the spirit of the present disclosure and other securing mechanisms may be utilized to secure the content discharge valve 118 within the inlet/outlet orifice 404.

Referring now to FIG. 5, a cross-sectional view of the apparatus 100 is shown with additional components attached thereto. Specifically, the view shown in FIG. 5 comprises a content discharge tube connector 515 that serves as the interfacing mechanism between the cast cap 102 and the content discharge tube 309 (not shown in FIG. 5). The content discharge tube connector 515 provides a mechanism with which the content discharge tube 309 may be securely affixed to the cast cap 102 of the sealing apparatus 100. According to one aspect, the content discharge tube connector 515 is generally inserted into the content discharge tube connector sleeve 414 within the cast cap 102. Further, according to another aspect, the opposing segment of the content discharge tube connector 515 is affixed to the content discharge tube 309. The content discharge tube connector may comprise various connecting mechanism for attaching to the other embodiments (e.g, high-strength adhesive, epoxy, threads, ball-lock posts, etc.).

Figure 6:
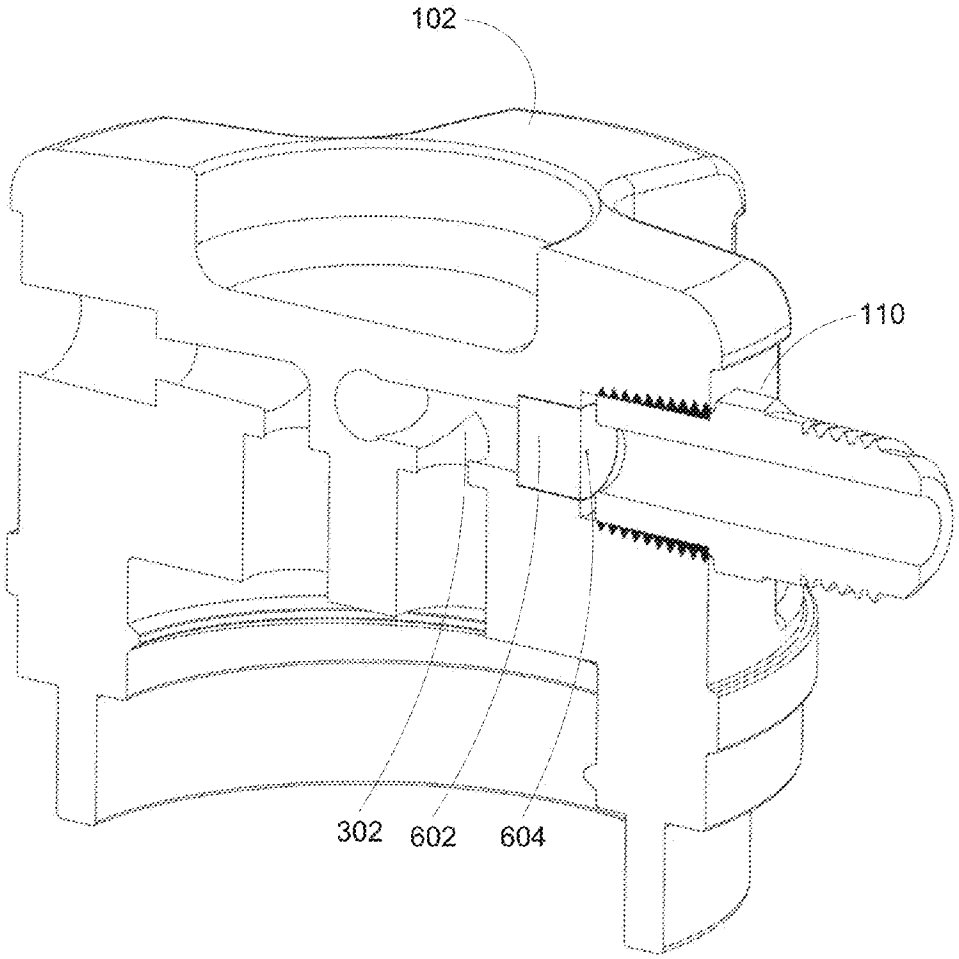
FIG. 6 is a cross-sectional view of an embodiment of the cast cap illustrating an exemplary location of a restrictor plate element.

FIG. 6 illustrates an embodiment comprising a restrictor plate 602 located at the entrance of the gas supply tube 302 abutting the gas inlet valve 110. According to one embodiment, the restrictor plate 602 reduces the flow of pressurized gas entering the vessel 114 by reducing the size of the orifice the pressurized gas travels through before entering the vessel 114. Reducing the flow of gas ensures promotes a more gradual and smoother insertion of gas into the vessel and further ensures the contents of the vessel 114 are not over pressurized (which can impact the freshness/quality of the liquid contained therein and can potentially damage the vessel 114 or components of the apparatus 100). Further, in one embodiment, the restrictor plate also prevents liquid within the container from unintentionally leaking through the channel 302 into the gas inlet valve 110 or the gas dispensing container 108.

In one aspect, the restrictor plate 602 generally comprises a rigid material (e.g., polymer, metal, plastic, etc.) with a small perforation or microchannel 604 near the center of the restrictor plate 602. Generally, the microchannel 604 extends axially through the restrictor plate 602, thereby creating a small hole or channel through the plate. Accordingly, in one embodiment, the restrictor plate 602 blocks the entire orifice that comprises the exit of the gas supply tube 302, thereby impeding the flow of incoming pressurized gas, and forcing the pressurized gas to travel through the small perforation 604 for entry into the vessel 114.

Figure 7:
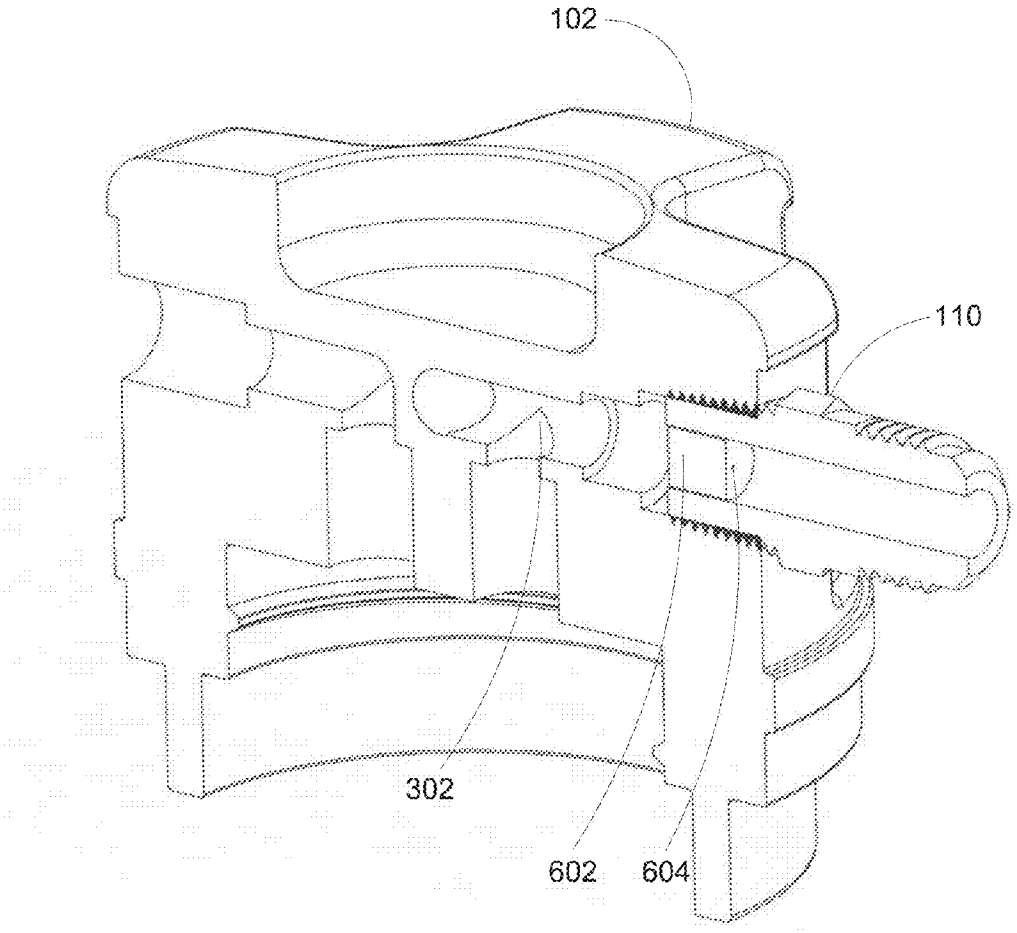
FIG. 7 is a cross-sectional view of an embodiment of the cast cap illustrating an exemplary alternate location of a restrictor plate element.

FIG. 7 illustrates a cross-sectional view of another embodiment of the present device 100 comprising a restrictor plate 602 located within the gas inlet valve. Similar to the embodiment shown and described in connection with FIG. 6, the restrictor plate 602 generally serves as a mechanism to reduce the flow of gas that enters the vessel 114 and before interacting with the contents of the vessel 114. This embodiment comprises a small perforation 604 through which gas must pass prior to entry into the gas supply tube 302 within the cast cap 102. As will be generally understood by one of ordinary skill in the art, the two aforementioned embodiments described in FIGS. 6 and 7 are purely exemplary locations at which the restrictor plate 602 may be located within the cast cap 102 and are not intended to limit the scope or spirit of the present disclosure.

Additionally, the desired functionality of the restrictor plate 602 (e.g., reduction and evening of gas flow into the cap 102 and prevention of liquid into the valve 110 or gas dispensing container 108) can be accomplished in other ways via other device embodiments. For example, a flange may be utilized in place of the restrictor plate to slow the flow of gas into the vessel and similarly prevent liquid from entering the valve 110. Other mechanisms for accomplishing the functionality of the restrictor plate 602 are contemplated by the present disclosure as will occur to one of ordinary skill in the art.

The foregoing description of the exemplary embodiments have been presented only for the purposes of illustration and description and is not intended to be exhaustive or to limit aspects of the present disclosure to the precise forms disclosed for allowing the device to seal a vessel and enable discharging and filling of contents without compromising the seal. Furthermore, other embodiments of the present sealing apparatus include other mechanisms for re-pressurizing and maintaining pressure within a vessel. As will be further understood, embodiments of the present vessel sealing device may comprise sub-components that are manufactured from a variety of materials, including rubber, acrylics, nylon, steel, metal, plastics, and any other material that is customarily used in container cap or lid manufacturing. Further, embodiments of the present vessel sealing device may comprise various sizes to accommodate different-sized vessels. Many modifications and variations are possible in light of the above teaching.

The embodiments were chosen and described in order to explain the principles of the inventions and their practical application so as to enable others skilled in the art to utilize the inventions and various embodiments and with various modifications as are suited to the particular use contemplated. Alternative embodiments will become apparent to those skilled in the art to which the present inventions pertain without departing from their spirit and scope. Accordingly, the scope of the present inventions is defined by the appended claims rather than the foregoing description and the exemplary embodiments described therein.

What is claimed is:

1. A sealing apparatus for maintaining pressure within a vessel and enabling dispensing of contents from within the vessel, comprising:

a cap element adapted for releasably attaching to the vessel via an attachment means, wherein the cap element comprises at least three prongs extending radially-outwardly from a central axis of the cap element;

a first channel integrally molded within a first prong of the cap element for enabling transmission of gas from an external gas supply means through the first channel and into the vessel, wherein the first channel is operatively connected to the external gas supply means;

a second channel integrally molded within a second prong of the cap element for directing the contents of the vessel through the cap element during dispensing of the contents from the vessel; and a discharge sub-assembly operatively connected to the second channel for receiving and dispensing the contents of the vessel externally from the vessel.

2. The sealing apparatus of claim 1, wherein the gas supply means comprises a pre-pressurized, disposable $CO_2$ canister.

3. The sealing apparatus of claim 1, wherein the discharge sub-assembly further comprises:

a discharge valve affixed to the second channel at a position on the periphery of the second prong of the cap element;

a dispensing tube operatively connected to the discharge valve; and a flow regulating apparatus for selectively dispensing the contents from the vessel.

4. The sealing apparatus of claim 1, wherein the cap element comprises a unitary, cast member.

5. The sealing apparatus of claim 1, wherein the attachment means for releasably attaching the cap element to the vessel comprises one or more of the following: a threaded opening, a snap fit mechanism.

6. The sealing apparatus of claim 1, further comprising a contents out tube operatively connected to an interior portion of the second channel for directing the contents of the vessel through the contents out tube to the second channel.

7. The sealing apparatus of claim 1, wherein the vessel is capable of being pre-pressurized and receiving the contents through the dispensing sub-assembly.

8. The sealing apparatus of claim 1, wherein the contents comprise pressurized liquid or carbonated liquid.

9. The sealing apparatus of claim 1, wherein the vessel comprises a growler.

10. The sealing apparatus of claim 1, further comprising a pressure relief valve releasably affixed to an outer end of a third prong of the cap element for enabling release of gas from within the vessel.

11. The sealing apparatus of claim 10, wherein the pressure relief valve is configured to maintain an internal pressure of the vessel within a predetermined range of about 7-15 psi.

12. The sealing apparatus of claim 1, further comprising a restrictor plate positioned within the first channel for regulating the flow of gas through the first channel.

13. The sealing apparatus of claim 12, wherein the restrictor plate comprises a cylindrical shape having a diameter substantially equivalent to a diameter of the first channel, and wherein the restrictor plate includes a microchannel extending axially along the length of the restrictor plate to enable gas to flow therethrough.

14. The sealing apparatus of claim 1, further comprising a gas connector affixed to the first channel and the external gas supply means for operatively connecting the first channel and the external gas supply means.

15. The sealing apparatus of claim 14, further comprising a restrictor plate positioned within the gas connector for regulating the flow of gas through the first channel.

16. A fluid dispensing apparatus for maintaining a regulated pressure of a carbonated liquid within a growler while enabling selective dispensing of the carbonated liquid from the growler, comprising:

a generally cross-shaped cap adapted for securely attaching to an opening of the growler for maintaining a regulated pressure of the carbonated liquid within the growler, the generally cross-shaped cap comprising a substantially cylindrical base having thereupon four opposed, raised, generally rectangular members extending upwardly from the substantially cylindrical base and thereby forming a cross-shaped pattern;

an L-shaped gas supply channel passing through a first member of the four opposed, raised, generally rectangular members of the generally cross-shaped cap from a first point on the circumferential surface of the first member of the cap to a first point on a lower, interior surface of the cap, thereby creating a passageway for the flow of gas from the first point on the circumferential surface of the first member of the cap to the inside of the growler;

an external gas supply element operatively connected to the L-shaped gas supply channel at the first point on the circumferential surface of the first member of the cap;

an L-shaped liquid access channel passing through a second member of the four opposed, raised, generally rectangular members of the generally cross-shaped cap from a second point on the circumferential surface of the second member of the cap to a second point on the lower, interior surface of the cap, thereby creating a passageway for the flow of the carbonated liquid from the inside of the growler to the second point on the circumferential surface of the second member of the cap; and a discharge sub-assembly operatively connected to the L-shaped liquid access channel at the second point on the circumferential surface of the second member of the cap for selectively receiving and dispensing the carbonated liquid of the growler externally from the growler.

17. The fluid dispensing apparatus of claim 16, further comprising a restrictor element positioned within the L-shaped gas supply channel for regulating the flow of gas through the gas supply channel from the external gas supply element, the restrictor element creating a substantially complete blockage of the gas supply channel for slowing the injection of gas into the growler, wherein the restrictor element comprises a cylindrical plate having a diameter substantially equivalent to a diameter of the L-shaped gas supply channel, and wherein the restrictor plate includes a microchannel extending axially along the length of the restrictor plate to enable gas to minimally flow therethrough.

18. The fluid dispensing apparatus of claim 16, wherein the discharge sub-assembly further comprises:

a discharge valve affixed to the L-shaped liquid access channel at the second point on the circumferential surface of the second member of the cap;

a dispensing tube operatively connected to the discharge valve; and a flow regulating apparatus for selectively dispensing the carbonated liquid from the growler.

19. The fluid dispensing apparatus of claim 16, further comprising a pressure relief valve for maintaining the regulated pressure of the carbonated liquid within a predetermined pressure range.

20. A fluid dispensing apparatus for maintaining a regulated pressure of a carbonated liquid within a growler while enabling selective dispensing of the carbonated liquid from the growler, comprising:

a generally cross-shaped cap adapted for securely attaching to an opening of the growler for maintaining a regulated pressure of the carbonated liquid within the growler, the generally cross-shaped cap comprising a substantially cylindrical base having a threaded element for threadably attaching to the growler, the generally cross-shaped cap further comprising four spaced-apart, outwardly-extending arms extending radially-outwardly from an axis of the substantially cylindrical base for enabling convenient rotating and securing of the generally cross-shaped cap on to and off of the growler;

an L-shaped gas supply channel passing through a first arm of the four spaced-apart, outwardly-extending arms of the generally cross-shaped cap from a first point on the circumferential surface of the first arm of the cap to a first point on a lower, interior surface of the cap, thereby creating a passageway for the flow of gas from the first point on the circumferential surface of the first arm of the cap to the inside of the growler;

an external gas supply element operatively connected to the L-shaped gas supply channel at the first point on the circumferential surface of the first arm of the cap;

an L-shaped liquid access channel passing through a second arm of the four spaced-apart, outwardly-extending arms of the generally cross-shaped cap from a second point on the circumferential surface of the second arm of the cap to a second point on the lower, interior surface of the cap, thereby creating a passageway for the flow of the carbonated liquid from the inside of the growler to the second point on the circumferential surface of the second arm of the cap;

a discharge sub-assembly operatively connected to the L-shaped liquid access channel at the second point on the circumferential surface of the second arm of the cap for selectively receiving and dispensing the carbonated liquid of the growler externally from the growler;

a pressure relief exit channel passing through a third arm of the four spaced-apart, outwardly-extending arms of the generally cross-shaped cap from a third point on the circumferential surface of the third arm of the cap to an internal connecting point between the pressure relief exit channel and the L-shaped gas supply channel; and a pressure relief valve operatively connected to the pressure relief exit channel at the third point on the circumferential surface of the third arm of the cap for maintaining the regulated pressure of the carbonated liquid within a predetermined pressure range.

* * * * *